US008218802B2

(12) United States Patent
Arndt et al.

(10) Patent No.: US 8,218,802 B2
(45) Date of Patent: Jul. 10, 2012

(54) HEARING AID HAVING AN OCCLUSION REDUCTION UNIT AND METHOD FOR OCCLUSION REDUCTION

(75) Inventors: Georg-Erwin Arndt, Obermichelbach (DE); Frank Koch, Erlangen (DE); Ulrich Kornagel, Erlangen (DE); Stefanie Müller, Erlangen (DE); Gunter Sauer, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 511 days.

(21) Appl. No.: 12/311,629

(22) PCT Filed: Oct. 10, 2007

(86) PCT No.: PCT/EP2007/060783

§ 371 (c)(1), (2), (4) Date: Apr. 7, 2009

(87) PCT Pub. No.: WO2008/043792

PCT Pub. Date: Apr. 17, 2008

(65) Prior Publication Data

US 2010/0002896 A1 Jan. 7, 2010

Related U.S. Application Data

(60) Provisional application No. 60/850,693, filed on Oct. 10, 2006.

(30) Foreign Application Priority Data

Oct. 10, 2006 (DE) ..... 10 2006 047 965

(51) Int. Cl.
*H04R 25/00* (2006.01)

(52) U.S. Cl. ..... 381/318; 381/71.6

(58) Field of Classification Search ..... 381/71.6, 381/312–321

See application file for complete search history.

(56) References Cited

U.S. PATENT DOCUMENTS

| | | | | |
|---|---|---|---|---|
| 6,831,986 | B2 | 12/2004 | Kates | |
| 6,898,290 | B1 * | 5/2005 | Saunders et al. | 381/71.6 |
| 2003/0053647 | A1 * | 3/2003 | Kates | 381/318 |
| 2005/0232452 | A1 * | 10/2005 | Armstrong et al. | 381/317 |
| 2008/0063228 | A1 * | 3/2008 | Mejia et al. | 381/318 |

FOREIGN PATENT DOCUMENTS

| | | | |
|---|---|---|---|
| EP | 1251714 | A2 | 10/2002 |
| WO | WO 2004021740 | A1 | 3/2004 |
| WO | WO 2006037156 | A1 | 4/2006 |

* cited by examiner

*Primary Examiner* — Matthew E Warren
*Assistant Examiner* — Fang-Xing Jiang

(57) ABSTRACT

A method is described for reduction of occlusion effects in an acoustic appliance which closes an auditory channel, wherein an audio signal in the transmission path of the acoustic appliance is processed by a signal processing unit and is emitted via an output transducer, which is arranged in the auditory channel, as an acoustic signal. A resultant sound signal is then detected by an auditory channel microphone and is supplied to a variable loop filter which is arranged in a feedback loop of an occlusion reduction unit for the acoustic appliance. The output signal from the loop filter is injected into the transmission path of the audio signal. The occlusion reduction unit is in this case controlled adaptively, with at least one signal from the transmission path of the audio signal and/or from the feedback loop being used to control the loop filter for the occlusion reduction unit.

17 Claims, 4 Drawing Sheets

HEARING AID HAVING AN OCCLUSION REDUCTION UNIT AND METHOD FOR OCCLUSION REDUCTION

CROSS REFERENCE TO RELATED APPLICATIONS

This application is the US National Stage of International Application No. PCT/EP2007/060783, filed Oct. 10, 2007 and claims the benefit thereof. The International Application claims the benefit of German application No. 10 2006 047 965.3 filed Oct. 10, 2006 and benefit of a provisional patent application filed on Oct. 10, 2006, and assigned application No. 60/850,693. All of the applications are incorporated by reference herein in their entirety.

FIELD OF THE INVENTION

The invention relates to a hearing aid having a circuit for reduction of occlusion effects, and to a method for occlusion reduction.

BACKGROUND OF THE INVENTION

The expression occlusion means the closure of the auditory channel which occurs when wearing a hearing aid. A hearing aid or an earpiece of such an acoustic appliance placed in the ear seals the auditory channel from the external environment. In consequence, the hearing-aid wearer perceives his own voice to be much louder and more distorted than normal. This phenomenon is also referred to as the closure effect or occlusion effect. The occlusion effect is perceived as being highly unpleasant, and also makes it harder to perceive complex environmental noises, such as speech.

The occlusion effect occurs because of oscillations in the wall of the auditory channel. These oscillations are transmitted by means of so-called bone conduction from the vocal chords or other sound sources when speaking or chewing. They cause the walls of the soft part of the auditory channel to oscillate, in a similar way to a sound membrane. If, for example, the outer auditory channel is blocked by an earpiece, these oscillations produce a relatively high sound pressure level, since the sound cannot escape outward as in an open ear. The sound pressure may in this case be up to 30 dB higher than normal on the ear drum. The sound pressure increase depends on the frequency. The occlusion effect is particularly evident at lower frequencies below 1 kHz. The speaker's own voice may be amplified by up to 20 dB at these frequencies.

In order to reduce the occlusion effects which occur in a closed auditory channel, occlusion reduction circuits are also already known, in addition to mechanical solutions, for example so-called vent openings. In this case, loop filters are used, and are arranged in a feedback loop of the respective acoustic appliance. The output signal from the loop filter is in this case subtracted from the actual audio signal in order to attenuate the frequencies that have been amplified by the occlusion effect. So-called compensation filters are also used in order to compensate for the distortion caused by the occlusion reduction circuit itself, and are arranged in the transmission path of the audio signal. Both the loop filter and the compensation filter are in this case in the form of static filters, with predetermined coefficients.

However, it has been found that the conditions in which the occlusion reduction circuit operates can vary. This can relate to virtually all components of the acoustic system involved in the signal processing and to all the variables which could influence the signals. For example, the auditory channel may be widened when wearing a hearing aid. In consequence, the transfer function of the corresponding variable also changes. Furthermore, during operation, a hearing aid is also subject to various external influences, such as different noise links which, for example, can influence the audibility of different noise sources. A static system for reduction of occlusion effects is not able to ensure optimum performance and thus comprehensibility in all the various operating conditions.

SUMMARY OF THE INVENTION

The object of the invention is therefore to provide a method which allows occlusion effects to be reduced better. A further object of the invention is to provide an apparatus by means of which the reduction of occlusion effects can be improved. This object is achieved by a method for occlusion reduction and by an acoustic appliance having the features of the claims. Further advantageous embodiments of the invention are specified in the dependent claims.

According to the invention, a method is provided for reduction of occlusion effects in an acoustic appliance which closes an auditory channel, in which an audio signal in the transmission path of the acoustic appliance is processed by a signal processing unit and is emitted via an output transducer, which is arranged in the auditory channel, as an acoustic signal. A resultant sound signal in the auditory channel is in this case detected by an auditory channel microphone and is supplied to a variable loop filter which is arranged in a feedback loop of an occlusion reduction unit for the acoustic appliance. An output signal from the loop filter is then injected into the transmission path of the audio signal, in order to reduce the occlusion signal in the auditory channel. In this case, the occlusion reduction unit is adaptively controlled, with at least one signal from the transmission path of the audio signal and/or from the feedback loop being used to control the loop filter for the occlusion reduction unit. The control of the loop filter allows the effect of the occlusion reduction circuit to be matched to different conditions, which may be caused by changes in the components involved in the signal processing or signal forming, and variables of the acoustic appliance. In addition, compensation can be provided in this way for effects which are caused by changes in external factors, such as varying noise links or widening of the auditory channel. Optimum occlusion reduction and an adequate stability margin are therefore always possible.

In one advantageous embodiment of the invention, the transfer function is monitored from the input to the output transducer to the output from the auditory channel microphone, and, in the event of any change in the transfer function, at least one filter in the occlusion reduction unit is readjusted in order to optimize the occlusion reduction. The knowledge of the transfer function from the input to the output transducer to the output from the auditory channel microphone makes it possible to use simple measures to compensate for effects which are caused by changes in external influencing variables.

One particularly advantageous embodiment of the invention provides for the transducer transfer function to be observed with the aid of an input signal to the output transducer and an output signal from the auditory channel microphone, with the result being used to determine the filter coefficients of the corresponding filter. These two signals can be used to detect changes in the transducer transfer function, in a particularly simple manner.

A further advantageous embodiment of the invention provides for the input signal to the output transducer and the output signal from the auditory channel microphone to be down-decimated to a lower sampling rate before they are used to determine the transducer transfer function. This makes it possible to reduce the required computation complexity.

In a further advantageous embodiment of the invention, the transducer transfer function is measured with the aid of an NLMS algorithm. The result of this method step is in this case supplied to a computation unit, which is used to control the corresponding filter. The method used is particularly highly suitable for use in a hearing aid, owing to its very high efficiency, simple implementation and robustness.

A further advantageous embodiment of the invention provides for changes in the transfer function to be observed only at one specific frequency or in a specific narrow frequency band. For this purpose, the input signal to the output transducer and the output signal from the auditory channel microphone each pass through a bandpass filter before they are used to determine the transducer transfer function. The concentration at one individual frequency or in a narrow frequency range makes it possible to greatly reduce the required computation complexity. It is therefore possible to also implement the corresponding method in hearing aids with relatively little computation power.

One particularly advantageous embodiment of the invention provides for the instantaneous transfer function from the input to the output transducer to the output from the auditory channel microphone to be determined by means of an output signal from the compensation filter and an input signal to the output transducer. In this case, the instantaneous transfer function is determined only when no occlusion signal is present. This method allows real-time determination of the instantaneous transfer function of the closed loop. Furthermore, in a further advantageous embodiment of the invention, the result of this method step is used to determine the loop gain and/or the form of the loop filter. This allows real-time matching of the respective filters for the occlusion reduction unit.

A further particularly advantageous embodiment of the invention provides for the occlusion transfer function to be observed, with at least one filter for the occlusion reduction unit being readjusted in the event of a change in the occlusion transfer function, in order to optimize the occlusion reduction. Simple measures can also be used if the occlusion transfer function is known to compensate for effects which are caused by changes in internal and external influencing variables.

Furthermore, one advantageous embodiment of the invention provides for the instantaneous occlusion transfer function to be determined with the aid of the output signal from the compensation filter and the input signal to the output transducer. In this case, the instantaneous transfer function is determined only when no occlusion signal is present. This method likewise allows the instantaneous occlusion transfer function to be determined in real time.

One advantageous embodiment of the invention provides for detection of whether an occlusion signal is present. Since the transducer transfer function and/or the occlusion transfer function can be determined correctly on the basis of the output signal from the compensation filter and the input signal to the output transducer only when the occlusion signal is equal to zero, this makes it possible, in a particularly simple manner, to prevent the filters being matched on the basis of an incorrectly determined transfer function.

A further advantageous embodiment of the invention provides for changes in the respective transfer function to be observed only at one specific frequency or in a specific narrow frequency band. For this purpose, the input signal to the output transducer and the output signal from the compensation filter each pass through a bandpass filter before they are used to determine the respective transfer function. Concentration on a single frequency or a narrow frequency range makes it possible to greatly reduce the required computation complexity. It is therefore possible to implement the corresponding method even in hearing aids with relatively little computation power.

One particularly advantageous embodiment of the invention provides for a signal level to be determined in the feedback part of the feedback loop, and for the loop gain to be set as a function of the determined signal level. In this case in particular, the level of the output signal from the auditory channel microphone is determined and is used to control the loop gain of the loop filter, with the loop gain being reduced when the level of the output signal from the auditory channel microphone falls, and with the loop gain being increased when the level of the output signal from the auditory channel microphone rises. This makes it possible to optimize the occlusion reduction unit such that disturbing noise sources, in particular the analog elements in the feedback loop, are no longer perceived. In this case, it is also advantageous to use the signal level determined in the feedback loop to control the compensation filter. This makes it possible to compensate for distortion of the audio signal caused by changes in the loop gain.

In a further particularly advantageous embodiment of the invention, at least one element of the occlusion reduction unit is controlled with the aid of information from the signal processing unit. In particular, the loop filter and/or the compensation filter of the occlusion reduction unit are/is controlled with the aid of signals from the signal processing unit such that the effect of the occlusion reduction unit is reduced when there is no or only a small audio signal, and/or when a low gain is set for the audio signal along its transmission path. This makes it possible to reduce the perceptibility of additional noise sources.

The invention also provides an acoustic appliance for use in an auditory channel which comprises a transmission path for an audio signal having a signal processing unit in order to process the audio signal as a function of the purpose of the acoustic appliance and an output transducer in order to output the processed audio signal as an acoustic signal into the auditory channel, as well as an occlusion reduction unit which follows the signal processing unit and has a feedback loop. The feedback loop in this case has an auditory channel microphone in order to detect a resultant sound signal in the auditory channel, and a variable loop filter in order to process the sound signal which is detected by the auditory channel microphone, and to inject it into the transmission path of the audio signal. In this case, a control unit is provided for the loop filter and is designed to control the loop filter with the aid of at least one signal from the transmission path of the audio signal or from the feedback loop. The control unit makes it possible to match the filters for the occlusion reduction unit to different conditions. It is therefore always possible to ensure that the occlusion reduction unit has an optimum effect.

In a further advantageous embodiment of the invention, a voice detector and/or a detector for the occlusion signal are/is provided in order to detect the presence of the occlusion signal. A voice detector makes it possible to detect in a particularly simple manner whether an occlusion signal is present. The control unit is in this case designed to prevent the transfer function of the path from the input to the output transducer to the output from the auditory channel microphone from being determined when an occlusion signal is detected. This makes it possible to ensure that the filters are not matched on the basis of incorrect values for the transducer transfer function.

BRIEF DESCRIPTION OF THE DRAWINGS

The invention will be explained in more detail in the following text with reference to drawings, in which.

DETAILED DESCRIPTION OF THE INVENTION

Figure 1:
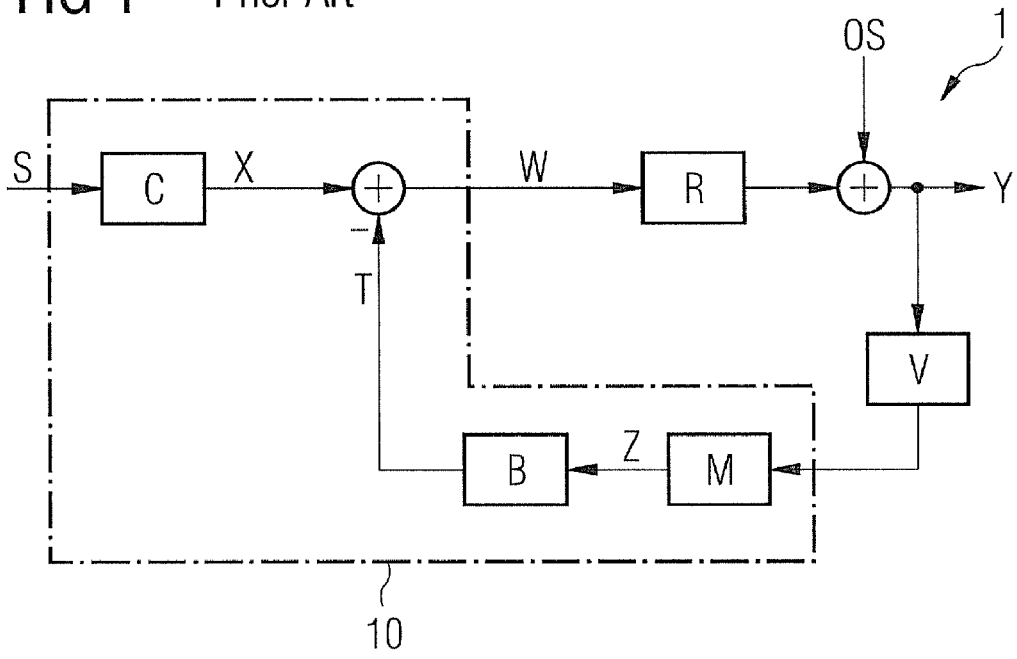
FIG 1 Prior Art
FIG. 1 shows a block diagram of a conventional occlusion reduction unit.

FIG. 1 shows, schematically, the configuration of a conventional acoustic appliance which is used as a hearing aid, having an occlusion reduction unit. The hearing aid, which may not only be in the form of a hearing aid but also an active noise protection appliance, has a transmission path for an audio signal S. Various signal processing components are arranged along the transmission path and are used to process the audio signal S. In this case, the audio signal S can be processed appropriately for the purpose of the acoustic appliance 1, with the aid of a signal processing unit. In the case of a hearing aid, the audio signal S is processed in the signal processing unit inter alia with the aid of filter and amplifier circuits, in order to compensate for the individual hearing loss. Since the signal processing in modern hearing aids is normally carried out digitally, this is preferably a digital signal processing processor DSP. At the end of the transmission path, the audio signal S is emitted as a sound signal to the auditory channel via an earpiece R, generally an electroacoustic output transducer. The output transducer R is preferably a loudspeaker. In order to inject acoustic signals from the surrounding area into the acoustic appliance 10 as electrical signals, an input transducer, which is not shown in FIG. 1, is preferably provided, for example an input microphone. Appropriate signal inputs can also be provided as well, in order to inject electrical signals or electromagnetic radio signals. If the hearing aid uses digital signal processing, an analog signal which is injected into the acoustic appliance must first of all be digitized. An A/D (analog/digital) transducer is normally provided at the start of the transmission path for this purpose. In a corresponding manner, the digital audio signal must be converted back to an analog signal again with the aid of a D/A (digital/analog) transducer at the end of the transmission path before it can be emitted into the auditory channel via the output transducer as an acoustic signal. The D/A transducer is frequently already integrated in the output transducer, so that the electroacoustic output transducer can be driven directly, digitally.

The electronic occlusion reduction unit is typically formed by a feedback loop which comprises an auditory channel microphone M and a filter element B. The auditory channel microphone M detects the currently prevailing sound field in the auditory channel and produces an electrical output signal Z. This signal passes through the loop filter B, in which it is formed in accordance with the filter settings. The output signal T from the loop filter B is then subtracted from a signal X in the transmission path of the audio signal S. If the loop filter B is optimally set, those relatively low frequencies of the audio signal S which occur to an increased extent in the auditory channel as a result of the occlusion effects are particularly heavily attenuated. The output signal Z, which may be in analog form, from the auditory channel microphone M is also converted to a digital signal before it can be processed further digitally in the feedback loop.

The occlusion reduction unit 10 which follows the signal processing unit DSP generally results in the audio signal S being subject to linear distortion. A compensation filter C is used in order to compensate for this distortion. This filter C, which is also referred to as a pre-equalization filter, is typically arranged in the transmission path of the audio signal S between the signal processing unit DSP and the output transducer R.

In principle, any desired acoustic input transducer arranged in the auditory channel can also be provided instead of an auditory channel microphone M. Furthermore, the output transducer R and the auditory channel microphone M can also be combined with one another, using the principle of signal superposition. In this case, by way of example, the earpiece speaker R also acts as a sound receiver, so that there is no need for a separate auditory channel microphone M, provided that the circuit is appropriately designed.

In order to make it possible to make a statement that is as accurate as possible about the profile of a signal along its transmission path, it is necessary to know as far as possible all of the variables which influence the respective signal in the corresponding transmission path. In order to assess the extent to which the occlusion effects which occur in the auditory channel are actually reduced with the aid of the occlusion reduction unit 20, the transfer functions of the elements contained in the feedback loop, such as the output transducer and the auditory channel microphone, must be taken into account. Since the resultant sound field in the auditory channel also depends on the geometry of the closed auditory channel volume, this variable, or the transfer function V of the auditory channel volume, must also be taken into account.

However, it is virtually impossible to directly analyze every individual variable which influences the signal in a hearing aid. However, this is not absolutely essential for optimization of the occlusion reduction. In fact, it is sufficient to know only the effect which all the components and variables involved have on the respective signal. This effect can in general be determined sufficiently just by analysis of a small number of signals.

Figure 2A:
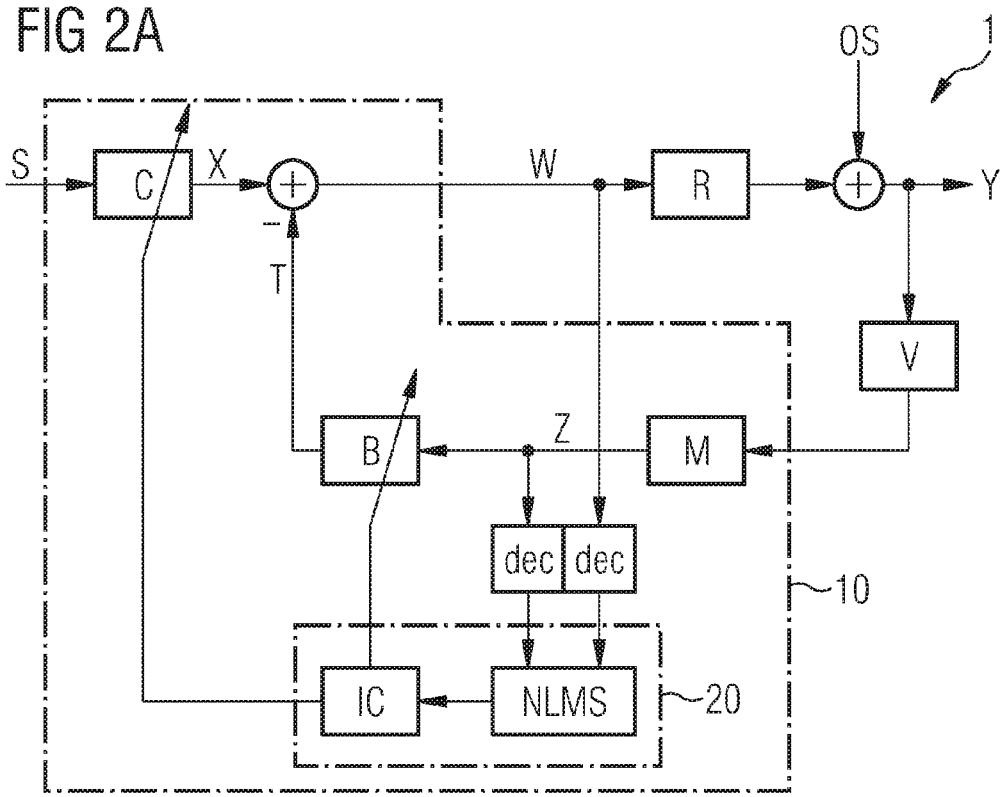
FIGS. 2A and 2B show block diagrams of two variants of a first embodiment of the apparatus according to the invention, with the transducer transfer function being determined adaptively.

The circuit shown in FIG. 2A represents a network whose components and signals influence one another. Network analysis for the occlusion reduction transfer function results in the following equation:

$$\frac{Y}{OS} = \frac{1}{1 + BMVR}$$

In this case, Y represents the signal at the eardrum, OS the occlusion signal which occurs in the closed auditory channel, B the transfer function of the loop filter, M the transfer function of the auditory channel microphone, V the transfer functions of the auditory channel volume and R the transfer function of the output transducer.

The amount of occlusion reduction is thus directly dependent on the product RVM, the so-called transducer transfer function, and thus on the possibly fluctuating variables M, V and R. The transfer function M of the auditory channel microphone could fluctuate, for example, because of moisture effects. Slight widening of the auditory channel volume could in contrast lead to a change in the corresponding transfer function V. An increase in the product RVM caused by an unpredictable change in the variables M, V or R involved, in comparison to the value on initialization of the system leads to a reduction in the stability margin of the closed loop. The system then has a tendency to produce feedback effects, the typical whistling. In contrast, a reduction in the product RVM leads to the occlusion reduction having a reduced effect. If the product of the transfer functions, that is to say the transducer transfer function RVM during operation is known, various measures can be derived from this in order on the one hand to optimize the occlusion reduction and on the other hand to ensure an adequate stability margin. In this case, for example, the loop filter B and the loop gain g applied to the output signal from the loop filter B can be matched so as to achieve optimum occlusion reduction. Maintenance of the stability margin at the same time also provides whistling protection.

It is therefore necessary to obtain knowledge that is as accurate as possible about the instantaneous transducer transfer function RVM and about changes in it, in order to use various measures derived for the signal processing to enable the occlusion reduction to be matched to the changed conditions. A first embodiment of the invention for carrying out an adaptive method for determination of the transducer transfer function RVM will be described in more detail in the following text in conjunction with FIG. 2A.

A statement about the transducer transfer function RVM can be derived in particular by observation of the combination signal W and the output signal Z from the auditory channel microphone M. This can be done, for example, with the aid of the normalized least mean-square (NLMS) algorithm. This algorithm is distinguished in particular by its high efficiency, simple implementation and robustness. Furthermore, this method represents a compromise that is suitable for the present purpose with respect to its characteristics and the required computation complexity. In principle, however, other iterative solution approaches, such as the LMS (least-mean square) or RLS (recursive least squares) algorithm can also be used for adaptively determining the filter coefficients. An RLS filter, for example, converges more rapidly than the NLMS algorithm used here, that is also associated, however, with considerably more computation complexity. The method that is finally used therefore depends not least on the available computation capacity. Since satisfactory results have already been possible using the NLMS algorithm, more complex filters are preferably not used in a hearing aid with restricted computation power.

As is illustrated in FIG. 2A, a control unit 20 is provided which has a corresponding NLMS block with two signal inputs. In this case, the combination signal W tapped off in the signal path of the audio signal S is applied to the first signal input of the NLMS block, while the output signal Z, tapped off in the feedback part of the loop, from the auditory channel microphone M is applied to the second signal input.

In order to reduce the occlusion effects as much as possible, the loop delay must be as short as possible. The digital signal processing which directly relates to the loop is therefore preferably carried out at a higher sampling rate than is generally the case in hearing aids. In this case, the two signals W and Z are also available at the higher sampling rate. However, an increased sampling rate also requires more computation complexity for the NLMS algorithm, since more data occurs per unit time. In order to reduce this computation complexity, it is worthwhile down-decimating both signals W, Z to a lower sampling rate. Specific components, so-called dec blocks, can be provided for this purpose, and are in each case arranged between a signal line and the corresponding signal input of the NLMS block.

The NLMS block of the control unit 20 determines the desired filter coefficients for the corresponding components B, C of the occlusion reduction circuit, and produces them at its output. These coefficients include the impulse response of the transfer function RVM from the input of the output transducer R to the output from the auditory channel microphone M and are used by a computation unit IC, in which a complex optimization process is carried out, as the basis for determination of the optimum filter settings. The computation unit IC, which is likewise part of the control unit 20, then controls the signal-processing components B, C of the occlusion reduction unit, in which case the filter characteristics and gain of the two filter circuits B and C can in each case be set independently of one another. As is shown in FIG. 2A, appropriate control lines are provided for this purpose, connecting the computation unit IC to the loop filter B and to the compensation filter C.

If the instantaneous transducer transfer function RVM is known completely, the optimum coefficients for the loop filter B and the compensation filter C can be obtained in real time. The occlusion reduction unit is then able to react immediately to changes in the transducer transfer function RVM. However, this is dependent on a relatively high computation capacity in the corresponding hearing aid.

However, if sufficient computation power cannot be provided in the hearing aid in order to adaptively determine the transducer transfer function RVM in real time, the computation complexity can also be reduced at the expense of functionality. For this purpose, using a single static measurement, the product of the frequency responses RVM are measured using the NLMS algorithm and the result is transmitted to a computer connected to the hearing aid. The optimum coefficients for the filters B and C are then determined in the external computer. The determined coefficients are then transmitted to the hearing aid 1.

Figure 2B:
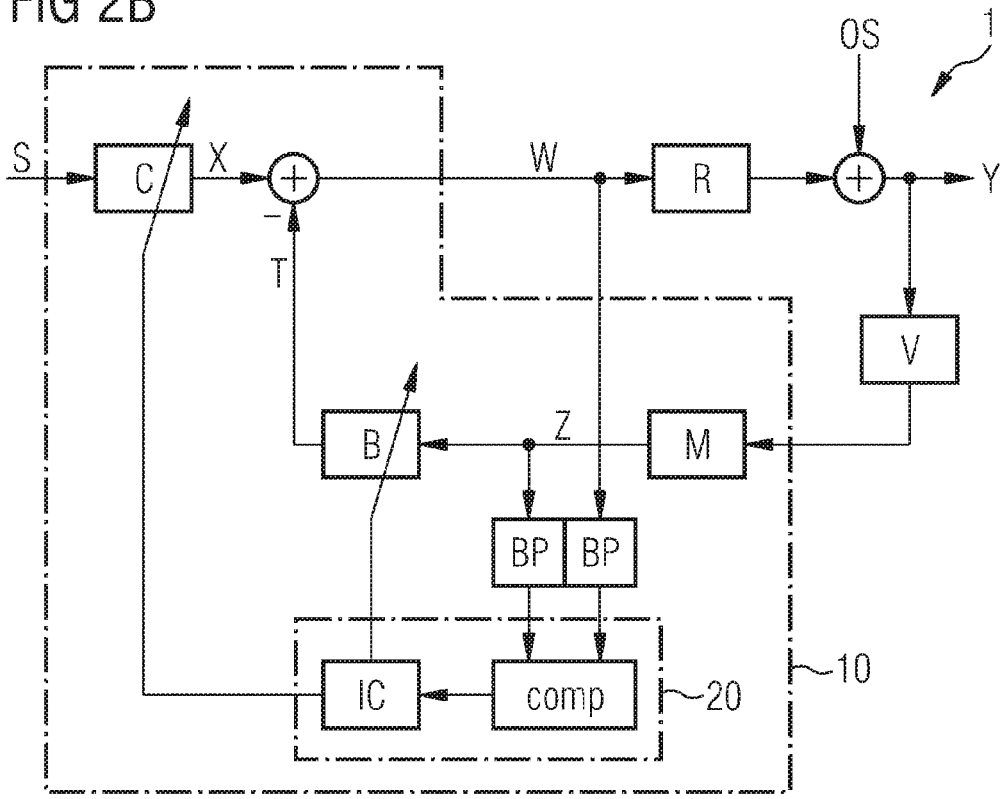

However, it may also be worthwhile observing changes in the transducer transfer function RVM in only a restricted frequency range, instead of having to analyze the entire frequency response of the transducer transfer function RVM. This is the situation in particular when the transducer transfer function RMV changes substantially over a broad bandwidth. Since there is no longer any need to monitor the entire frequency response, this method requires considerably less computation power. FIG. 2B shows an alternative embodiment such as this of the occlusion reduction unit 10, in which changes in the transfer function RVM are monitored only in a narrow frequency range.

The concentration on one frequency or a sufficiently narrow frequency band allows the required computation complexity to be reduced sufficiently that a real time measurement can be carried out using the NLMS algorithm, even in a hearing aid 1 with relatively little computation power. The reduced data processing also results in a reduction in the power consumption. This is particularly advantageous in the case of in-the-ear hearing aids since, in this case, only a relatively small battery is used as the power source, because of the small housing dimensions.

However, changes in the transducer transfer function RVM can also be detected by simultaneously or successively observing two or more specific frequencies or narrow frequency bands. If suitable frequencies are chosen, this method also makes it possible to identify those changes in the transducer transfer function RVM which affect only specific frequency ranges. Depending on the application, this method can also be used to reduce the computation complexity required in comparison to computation-intensive observation of the entire frequency response.

If the intention is to use only a restricted frequency range for determination of changes in the transducer transfer function RVM, it is worthwhile filtering those frequency ranges which are not of interest out of the signals to be analyzed. This can be done, for example, with the aid of bandpass filters. FIG. 2B shows one such occlusion reduction unit in which the signals W, Z tapped off in the corresponding signal lines each pass through a bandpass filter circuit BP before being supplied to the control unit 20.

In this case as well, it is worthwhile down-decimating the signals W, Z detected in the signal path of the audio signal S or in the loop to a lower sampling rate if they are at a high sampling rate. Analogously to FIG. 2A, corresponding units can be provided for this purpose, although these are not illustrated in FIG. 2B, for clarity reasons. Corresponding dec blocks are preferably arranged upstream of the bandpass filter circuits BP. Alternatively, the dec blocks may, however, also be arranged between the bandpass filter circuits BP and the NLMS block.

Since the present exemplary embodiment is based on a broadband change to the transducer transfer function RVM, only the amplitude, but not the frequency response, of the corresponding signals changes. It is therefore sufficient to observe only the amplitudes of the filtered signals W and Z.

This is done using an evaluation circuit COMP which is preferably in the form of a comparison unit or comparator. In this case, the two signals W, Z are assessed on the basis of reference values stored in the hearing aid. It is possible for the reference values to be determined in advance, for example by an appropriate measurement during the initialization of the hearing aid. The computation unit IC uses the comparison result to calculate the optimum settings for the components B, C of the occlusion reduction unit. In the event of any disturbances between the instantaneously determined values of the signals W, Z and the reference values, the computation unit IC can appropriately readjust the filters B, C.

In this case, only the broadband gain of the filters B and C is preferably matched. In contrast, the form of the filters B, C is fixed, and is preferably not changed. The optimum frequency response of the filters B, C will have been determined, for example, in a specific matching process for the hearing aid.

As has already been described in conjunction with the exemplary embodiments in FIGS. 2A and 2B, conclusions can be drawn about the occlusion transfer function Y/OS by observation of the transducer transfer function RVM. The transducer transfer function RVM can in turn be derived directly by observation of signals of the occlusion reduction circuit. While, in the case of the exemplary embodiments described above, any change in the transducer transfer function RVM is detected with the aid of the combination signal W and the output signal Z from the auditory channel microphone M, the occlusion transfer function Y/OS can also be determined directly on the basis of the two internal variables W and X, when no occlusion signal OS is present:

$$\frac{W}{X} = \frac{1}{1 + gBMVR}\bigg|_{OS=0}$$

In this case, the transfer function of the closed loop can be determined from the combination signal W and the output signal X from the compensation filter C only when the value of the occlusion signal OS is equal to zero. Since the occlusion occurs in particular when the wearer of the respective hearing aid is speaking, it is advantageous to suppress the determination of the instantaneous transfer function whenever the hearing-aid wearer is speaking. This is possible since the change in the variable components and their transfer functions generally takes place sufficiently slowly. Provided that the transfer function is determined only during pauses in speech, the filter settings B, C determined on the basis of the values determined in this way provide a sufficiently well-matched occlusion reduction even in the respective subsequent speech phases. In order to determine the times at which the transfer function of the closed loop can be determined, it is possible to provide a special detector for the voice of the wearer of the respective hearing aid. Furthermore, for example, it would also be possible to use specific features of the sound signal resulting in the auditory channel to deduce whether the hearing aid wearer is speaking, and thus whether an occlusion signal OS is present.

This method makes it possible to determine the instantaneous transfer function of the closed loop continuously in real time. Depending on the determined values for the instantaneous transfer function, the loop gain g or, in a more advanced version, the parameter set of the loop filter B, can then be adapted. An optimum occlusion reduction and stability margin can therefore always be ensured by provision of an adaptive or level-dependent loop gain.

In principle, various alternatives are feasible for determination of the transfer function. On the one hand, the signals can be analyzed over the entire frequency range. This is dependent on transformation of the respective signals to the frequency domain. Furthermore, the magnitude of the transfer function can be determined just at specific frequencies of particular interest. This is particularly advantageous when the transfer function of the loop varies predominantly over a broad bandwidth. In this case, there is no need to transform the two signals W and X to the frequency domain, since changes in the transfer function can be observed directly from the amplitude at the respective frequencies. This second alternative can therefore be used to considerably reduce the required computation complexity.

Both alternatives allow the occlusion reduction, which is preferably defined during initialization of the system, and stability margins to also be maintained throughout operation. Since whistling protection is provided at the same time with a stability margin that is kept constant, there is no need for additional circuits to suppress feedback effects.

Figure 3:
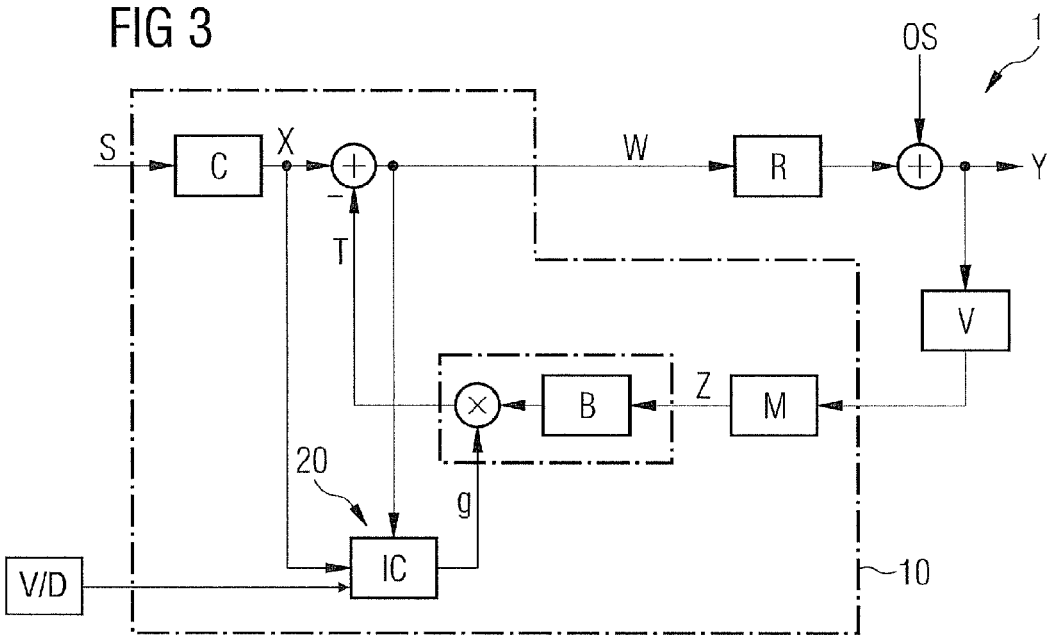
FIG. 3 shows a block diagram of a second embodiment of the apparatus according to the invention with adaptive loop gain.

FIG. 3 shows a corresponding apparatus with a level-dependent loop gain. In this case, the two signals W and X are tapped off in the transmission path of the audio signal S and are applied to two signal inputs of a computation unit IC. The computation unit IC uses the two signals W, X to calculate the instantaneous occlusion transfer function Y/OS, and then determines the gain factor g within the loop. For this purpose, the signal output of the computation unit IC is connected via a control line to a driver circuit, which is responsible for the loop gain g. Furthermore, the computation unit IC preferably has a further signal input, which is connected via a further signal line to an output of a voice detector or detector, represented by the block labeled V/D. The detector is used to detect the voice of the appliance wearer. The computation unit IC can use the detector signal to determine the time at which there is no occlusion signal OS in the auditory channel of the appliance wearer, and at which the occlusion transfer function can be determined using the signals W and X. The loop gain g is typically part of the loop filter B. For illustrative purposes, FIG. 3 shows the loop gain as a separate component.

In addition to excessively low occlusion reduction and an inadequate stability margin, the noise caused by the occlusion reduction circuit 10 itself can also adversely affect the perception of the audio signal S. In order to counteract this noise, a specific loop gain closed-loop control is provided in the following embodiment of the invention.

In comparison to an acoustic appliance without active occlusion reduction, the auditory channel microphone M, the associated preamplifier and the associated AID converter together represent an additional noise source. The level of the noise source at the earpiece output R in this case depends on the loop gain g. The audibility of this additional noise source in turn depends on the signal level of the normal signal path, that is to say the transmission path of the audio signal S. Particularly when the input levels are relatively low, that is to say when neither the wearer's own voice (occlusion signal) nor any external signal is present, the additional noise source is distinctly audible.

In order to ensure that the noise is not perceived, particularly in poor audibility conditions, level-dependent loop gain closed-loop control can be provided. However, in this case, it is also necessary to ensure that the occlusion reduction effect is not adversely affected by reducing the loop gain g.

In the case of level-dependent loop gain closed-loop control, the signal level is measured at a suitable point in the feedback part of the loop, and the loop gain g is reduced in comparison to the selected maximum value, for a medium to low level. Conversely, the loop gain g can be increased to the maximum value again as soon as the measured level rises again. In this case, the feedback part is the section of the feedback loop from the input to the auditory channel microphone M to the point at which the output signal from the loop filter B is subtracted from the audio signal S.

Since the wearer's own voice occurs exclusively at high levels, it can be assumed that the hearing aid wearer is not speaking and therefore that there is no occlusion signal as soon as the measured level falls below a specific threshold. In principle, it is therefore sufficient for the maximum loop gain g to be set only for high levels.

Figure 4:
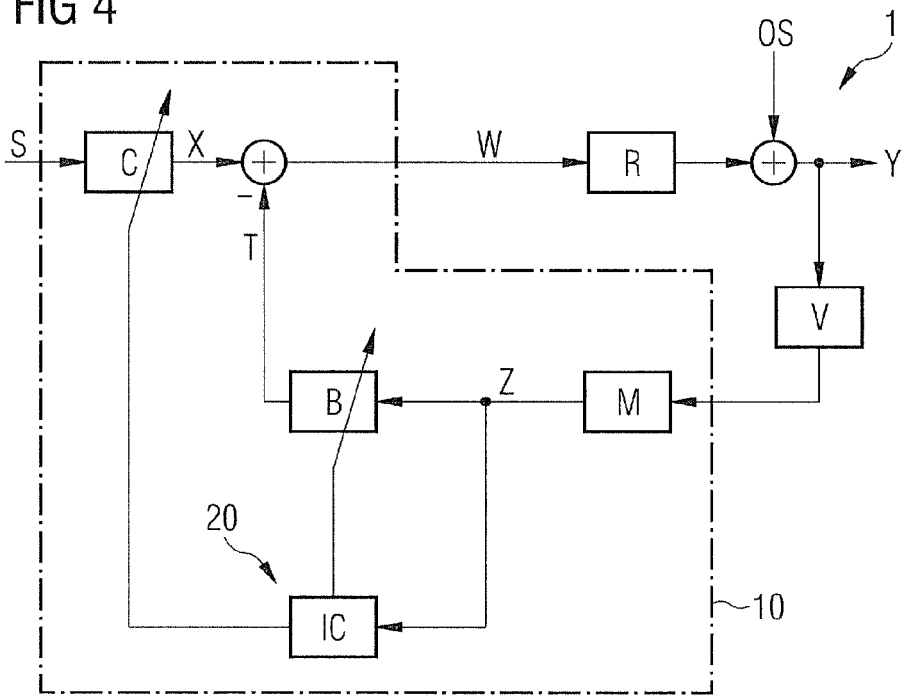
FIG. 4 shows a block diagram of a third embodiment of the apparatus according to the invention, in which the loop gain is controlled as a function of the signal level of the auditory channel microphone.

In principle, the signal level can be measured at any desired point in the feedback part of the loop. However, in order to determine the necessary thresholds, it is best to determine the level of the output of the auditory channel microphone M. As shown in FIG. 4, the signal Z which is tapped off downstream from the auditory channel microphone M is supplied to a computation unit IC. The computation unit IC then uses the measured signal level to determine the optimum settings for the respective components B, C of the occlusion reduction unit 10. In order to set the loop gain g, the computation unit IC is connected via a control line to the loop filter B. If the loop gain g is reduced, the distortion of the audio signal S caused by the occlusion reduction circuit 10 also changes. It is therefore worthwhile also appropriately adapting the compensation filter C. For this purpose, the computation unit IC is also connected to the compensation filter C via a further control line.

The maximum loop gain g can be avoided by appropriate adaptation of the threshold values with the aid of the circuit shown in FIG. 4 whenever the additional noise source represents a problem. Since the loop gain g also reduces the effect of the additional noise source, the noise source is no longer audible therein when correctly set.

Figure 5:
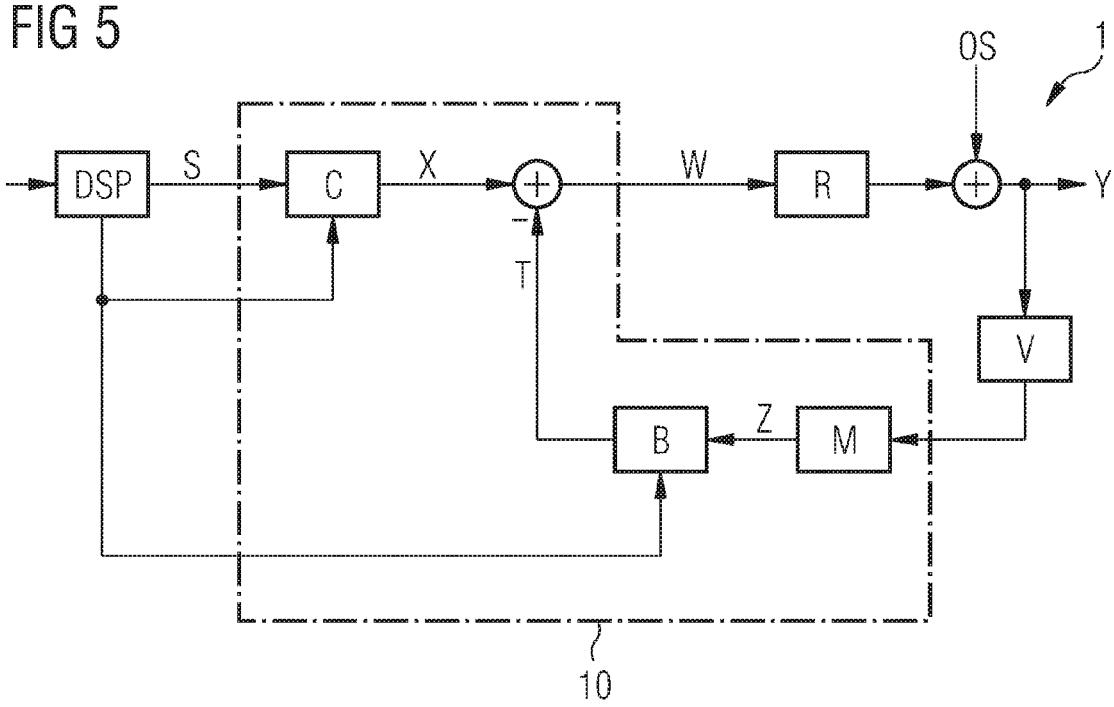
FIG. 5 shows a block diagram of a fourth embodiment of the apparatus according to the invention, in which the components of the occlusion reduction unit are controlled with the aid of signals from the signal processing unit.

The further embodiment of the invention illustrated in FIG. 5 also takes account of the fact that, in general, it is not always necessary or desirable for the occlusion reduction circuit to have the same effect. In particular, it is worthwhile matching the effect of the occlusion reduction unit 10 appropriately to the various audio signals being processed by the preferably digital signal processing unit DSP for the acoustic appliance. In this case, provision is made for the components of the occlusion reduction unit 10, in particular the loop filter B and the compensation filter C, to be controlled using signals from the signal processing unit DSP. Signals are preferably used in this case which are available in any case in the signal processing block DSP. This is indicated by appropriate arrows in FIG. 5.

By way of example, the auditory channel microphone M represents an additional noise source in the hearing aid, which in some circumstances is audible. This is the case in particular when the appliance gain, that is to say the gain of the audio signal S along its transmission path, is set to be relatively low, and there is no useful signal being applied to the two signal inputs, apart from the microphone noise. In this case, the effect of the occlusion reduction circuit 10 can sensibly be considerably reduced, or entirely eliminated. Furthermore, it may be worthwhile reducing the appliance gain when no actual useful signal is present, but only the noise from the input microphone at the input of the signal processing unit DSP. In the present embodiment of the invention, this is done by using information from the signal processing unit DPS of the acoustic appliance. For example, the gain g of the loop filter B can be reduced in this way using information from the signal processing block DSP when there is no useful signal. Since any change in the loop gain g also results in a change in the distortion caused in the audio signal S by the occlusion reduction unit 10, it is also worthwhile appropriately adapting the compensation filter C. The components B, C in the occlusion reduction unit 10 are preferably controlled directly from the signal processing block DSP. However, in principle, it is also possible to provide a separate control unit which uses the information provided by the signal processing unit DSP to control the components B, C in the occlusion reduction unit 10.

Both the description above and the claims always adopt an abstract view of the signals rather than their purely analog or digital representation. In the case of a digital hearing aid, it is therefore necessary to ensure that the signals used to determine the appropriate variables have both analog components and digital components. Since the digital components are generally known, they can, however, easily be calculated out.

Although the invention has been explained with reference to its preferred embodiments, a person skilled in the art can, of course, carry out further possible modifications and changes without having to depart from the idea of the invention. In particular, the individual embodiments of the invention can be combined with one another in an acoustic appliance, depending on the requirements.

The invention claimed is:

1. A method for an occlusion reduction in an acoustic appliance, comprising:

processing an audio signal in a transmission path of the acoustic appliance by a signal processing unit;

emitting the processed audio signal as an acoustic signal by an output transducer;

detecting a sound signal by an auditory channel microphone;

supplying the sound signal to a loop filter arranged in a feedback loop of an occlusion reduction unit;

injecting an output signal of the loop filter into the transmission path;

observing a transfer function in the acoustic appliance, wherein the observing of the transfer function comprises observing changes in the transducer transfer function; and readjusting the loop filter based on a change in the observed transfer function for optimizing the occlusion reduction, wherein the processed audio signal passes through a compensation filter before being combined with the output signal from the loop filter, wherein the compensation filter is readjusted based on the change in the observed transfer function for optimizing the occlusion reduction, and wherein the output signal from the loop filter is injected into the transmission path between the compensation filter and the output transducer, and wherein the transfer function from the input of the output transducer to the output from the auditory channel microphone is determined based on the input signal to the output transducer and an output signal from the compensation filter, wherein the input signal to the output transducer and the output signal from the compensation filter are evaluated for determining a filter coefficient of the loop filter and the compensation filter, and wherein a determination of said transfer function based on the input signal to the output transducer and the output signal from the compensation filter is not performed when an occlusion signal is present.

2. The method as claimed in claim 1, wherein the transfer function product further comprises a third transfer function corresponding to a transfer function of a volume of the auditory channel, wherein the product of the first, second and third transfer functions comprises a transfer function from an input of the output transducer to an output of the auditory channel microphone, and wherein the transfer function is observed based on an input signal to the output transducer and a further signal from the transmission path or from the feedback loop.

3. The method as claimed in claim 1, wherein the transfer function from the input of the output transducer to the output of the auditory channel microphone is observed based on an input signal to the output transducer and an output signal from the auditory channel microphone, wherein the input signal to the output transducer and the output signal from the auditory channel microphone are evaluated for determining a filter coefficient of the loop filter and the compensation filter, and wherein the input signal to the output transducer and the output signal from the auditory channel microphone are down-decimated to a lower sampling rate before determining the transfer function from the input of the output transducer to the output of the auditory channel microphone.

4. The method as claimed in claim 3, wherein the transfer function from the input of the output transducer to the output from the auditory channel microphone is measured by a normalized least mean-square algorithm for adaptively readjusting the loop filter and the compensation filter.

5. The method as claimed in claim 1, wherein the transfer function from the input of the output transducer to the output from the auditory channel microphone is observed at a specific frequency or in a specific narrow frequency band, wherein the input signal to the output transducer and the output signal from the auditory channel microphone pass through a bandpass filter before determining the transfer function from the input of the output transducer to the output from the auditory channel microphone, and wherein an output signal form the bandpass filter is assessed by an evaluation circuit based on a reference value for adaptively controlling the loop filter and the compensation filter.

6. The method as claimed in claim 1, wherein the transfer function is measured for determining a loop gain of the loop filter.

7. The method as claimed in claim 1, wherein the method is used for detecting whether an occlusion signal is present.

8. The method as claimed in claim 1, wherein the change in the transfer function of the input of the output transducer to the output from the auditory channel microphone or the occlusion transfer function is observed at a specific frequency or in a specific narrow frequency band, and wherein the output signal from the compensation filter and the input signal to the output transducer pass through a bandpass filter before determining the respective transfer function.

9. The method as claimed in claim 1, wherein a level of the output signal from the auditory channel microphone is determined for controlling a loop gain of the loop filter, wherein the loop gain is reduced when the level of the output signal from the auditory channel microphone falls and is increased when the level of the output signal from the auditory channel microphone rises, and wherein the compensation filter is controlled by the level of the output signal.

10. The method as claimed in claim 1, wherein an element of the occlusion reduction unit is controlled by a signal of the signal processing unit, wherein the element is the loop filter or the compensation filter, and wherein an effect of the occlusion reduction unit is reduced when there is no or only a small audio signal in the signal processing unit or when a low gain is set for the audio signal.

11. An acoustic appliance for use in an auditory channel, comprising:

a signal processing unit that processes an audio signal in a transmission path;

an output transducer that outputs the processed audio signal as an acoustic signal into the auditory channel;

an occlusion reduction unit having a feedback loop comprising: an auditory channel microphone that detects a sound signal in the auditory channel, a loop filter that processes the detected sound signal and injects an output signal into the transmission path; and a control unit that observes a transfer function in the acoustic appliance and readjusts the loop filter based on a change in the observed transfer function for optimizing an occlusion reduction, wherein the control unit is configured to monitor changes in the transducer transfer function, wherein the processed audio signal passes through a compensation filter before being combined with the output signal from the loop filter, wherein the compensation filter is readjusted based on the change in the observed transfer function for optimizing the occlusion reduction, and wherein the output signal from the loop filter is injected into the transmission path between the compensation filter and the output transducer, and wherein the transfer function from the input of the output transducer to the output from the auditory channel microphone is determined based on the input signal to the output transducer and an output signal from the compensation filter, wherein the input signal to the output transducer and the output signal from the compensation filter are evaluated for determining a filter coefficient of the loop filter and the compensation filter, and wherein a determination of said transfer function based on the input signal to the output transducer and the output signal from the compensation filter is not performed when an occlusion signal is present.

12. The acoustic appliance as claimed in claim 11, further comprising a voice detector or a detector for an occlusion signal and wherein the transfer function is not determined when the occlusion signal is detected.

13. The acoustic appliance as claimed in claim 11, further comprising a unit for down-decimating signals that have been tapped off to a lower sampling rate.

14. The acoustic appliance as claimed in claim 11, wherein the occlusion reduction unit further comprises a compensation filter that is arranged between the signal processing unit and the output transducer.

15. The acoustic appliance as claimed in claim 14, wherein the control unit is connected to an input of the output transducer and to a signal line in the transmission path or in the feedback loop for tapping off signals.

16. The acoustic appliance as claimed in claim 15, wherein a bandpass filter is provided between the control unit and a corresponding signal line of the transmission path or the feedback loop for filtering the tapped-off signals.

17. The acoustic appliance as claimed in claim 15, wherein the control unit measures the tapped off signals by a normalized least mean-square algorithm and sets a gain of the loop filter or the compensation filter.

* * * * *